US007261108B2

(12) United States Patent
Dallianis et al.

(10) Patent No.: US 7,261,108 B2
(45) Date of Patent: Aug. 28, 2007

(54) LIQUID DISPENSING COMB

(75) Inventors: Diane Dallianis, Western Springs, IL (US); William Hughes, Woodstock, IL (US)

(73) Assignee: Diane L. Dallianis, Western Springs, IL (US)

( * ) Notice: Subject to any disclaimer, the term of this patent is extended or adjusted under 35 U.S.C. 154(b) by 0 days.

(21) Appl. No.: 11/237,275

(22) Filed: Sep. 28, 2005

(65) Prior Publication Data

US 2007/0068545 A1 Mar. 29, 2007

(51) Int. Cl.
*A45D 24/22* (2006.01)

(52) U.S. Cl. ..... 132/116; 132/112

(58) Field of Classification Search ..... 132/111–116; 222/94, 95, 192, 105, 106, 386.5, 212, 210
See application file for complete search history.

(56) References Cited

U.S. PATENT DOCUMENTS 2,597,200 A * 5/1952 Suprowich ..... 132/116
5,024,243 A * 6/1991 Snyder ..... 132/116
5,056,480 A * 10/1991 Murray, Sr. ..... 132/114
5,325,878 A 7/1994 McKay
5,482,058 A 1/1996 Garconnet
5,725,130 A * 3/1998 Kluge et al. ..... 222/192
5,909,737 A 6/1999 Ricco
5,927,290 A 7/1999 Thiruppathi
6,065,891 A 5/2000 Rehman et al.
6,257,246 B1 7/2001 Stinnett
6,334,449 B1 * 1/2002 Burrowes et al. ..... 132/114
2004/0118423 A1 6/2004 Stankovic et al.

* cited by examiner

*Primary Examiner*—Robyn Doan
(74) *Attorney, Agent, or Firm*—Georgakis & Chowdhury IP Law

(57) ABSTRACT

A liquid dispensing comb includes a handle portion and a head portion. The handle portion includes a container and a compressible chamber. The container may be formed from or consists of a collapsible substrate such as a bag and/or bladder, and is operative to store a liquid. The compressible chamber is operative to receive the liquid from the collapsible substrate for delivery to a plurality of nozzles. The head portion includes the plurality of teeth aligned in a row, a plurality of nozzles located, for example, between the teeth and a common delivery channel. The common delivery channel may be operably coupled to the compressible chamber and the plurality of nozzles.

10 Claims, 9 Drawing Sheets

10

10

LIQUID DISPENSING COMB

FIELD OF THE INVENTION

The invention relates generally to combs, and more particularly to liquid dispensing combs.

BACKGROUND OF THE INVENTION

Combs and brushes used for styling and grooming the hair are known. Furthermore, fluid-dispensing hair care devices for the medical, cosmetic, and pet industries are also known.

Adults often wet a child's hair to achieve the desired hair style, particularly for girls wearing ponytails, braids and the like. Also, it is often necessary to wet a child's hair to control static problems. In addition, many children are bathed at night at which time they have their hair washed. The next morning, however, it is often necessary for an adult to wet the child's hair to detangle the hair and to style unruly hair messed from the previous night's sleep. As such, different techniques are used to dampen a child's sensitive hair such as running a comb under a faucet or using a spray bottle to moisten the hair.

Devices are known relating to liquid dispensing hairbrushes involving a mechanism to spray liquid out of the bristles themselves. These hairbrushes utilize a disposable liquid cartridge and a vibrator that allows the user to spray a liquid and massage the scalp while brushing the hair. Yet another hairbrush includes absorbent feed rods mounted into bores inside the hairbrush bristles. The feed rods connect to roller-ball nozzles located at the end of the bristles in which liquid disburses over the user's scalp only during contact of the roller-balls with the scalp. However, these devices relate to hairbrushes and not to combs.

Devices are also known relating to a combination brush and hairspray system for the purpose of allowing a user to simultaneously brush and apply hairspray to the hair with only one hand. These devices incorporate a pump having an electric motor connected to it, requiring the use of batteries. A button is located on a head portion of the brush. In another embodiment, the user squeezes the handle to force the liquid out. However, these devices require many internal components such as motors, batteries, switches, pumps, etc., and therefore are complicated to make and use. Further, these devices relate to hairbrushes and not to combs.

Devices related to fluid dispensing combs, rather than a brushes, are also known. One known device relates to a fluid dispensing comb having an absorbent pad-type reservoir for storing and dispensing products to the hair such as hair oil, conditioner, coloring, lightener, highlighter, gloss and detangler. Another device relates to a spraying comb used to groom animal hair or fur. Yet another device has the purpose of dispensing liquids, including thick styling products, involving multiple detachable parts. Because these combs contemplate the dissemination of liquids other than merely water, special attention must be given to ensure that the products do not clog and are easy to clean. As such, they contain detachable or disposable parts, are difficult and costly to manufacturer, and are complicated to use.

While the devices described above may serve the purposes for which they were intended in the salon, medical, and pet industries, they are less optimal for use on a child's hair, for removing tangles, shaping unruly hair, and pulling back the hair into different hair styles in a manner that is simple and routine for the user. A comb containing closely held teeth, not a brush, is often necessary to serve these purposes. Furthermore, due to the complexities inherent in the above-mentioned devices, they would be costly to manufacturer as a retail product and would be difficult to assemble and operate for every-day use. As a result, the devices described above do not provide an inexpensive and convenient fluid-dispensing apparatus used for the grooming of a child's hair.

DETAILED DESCRIPTION OF THE PREFERRED EMBODIMENTS

The liquid dispensing comb includes a handle portion and a head portion. The handle portion includes a container and a compressible chamber. The container may be formed from or consists of a collapsible substrate such as a bag and/or bladder, and is operative to store a liquid. The compressible chamber is operative to receive the liquid from the collapsible substrate for delivery to a plurality of nozzles. The head portion includes the plurality of teeth aligned in a row, a plurality of nozzles located, for example, between the teeth, and a common delivery channel. The common delivery channel may be operably coupled to the compressible chamber and the plurality of nozzles.

Among other advantages, the liquid dispensing comb allows the user to spray out the available liquid while holding the comb in any orientation. The container suitably collapses as the compressible chamber draws liquid from the container such that either no air, a minimal amount of air or a substantially small amount of air is introduced into the container. As a result, the compressible chamber may draw liquid from the container when the liquid dispensing comb is in any position or orientation, such as when the liquid dispensing comb is moved or rotated. Additionally, the plurality of nozzles located between the teeth uniformly dispense the liquid. Among other applications, the liquid dispensing comb facilitates dispensing of the liquid while combing to assist in detangling, styling, combing and any other suitable activity. For example, the liquid dispensing comb quickly and efficiently facilitates combing the hair of a child. Additionally, the liquid dispensing comb preferably appears as a single structure to the user such that the liquid dispensing comb requires no assembly by a user. Further, the liquid dispensing comb may be easily and inexpensively manufactured using common manufacturing techniques.

Figure 1:
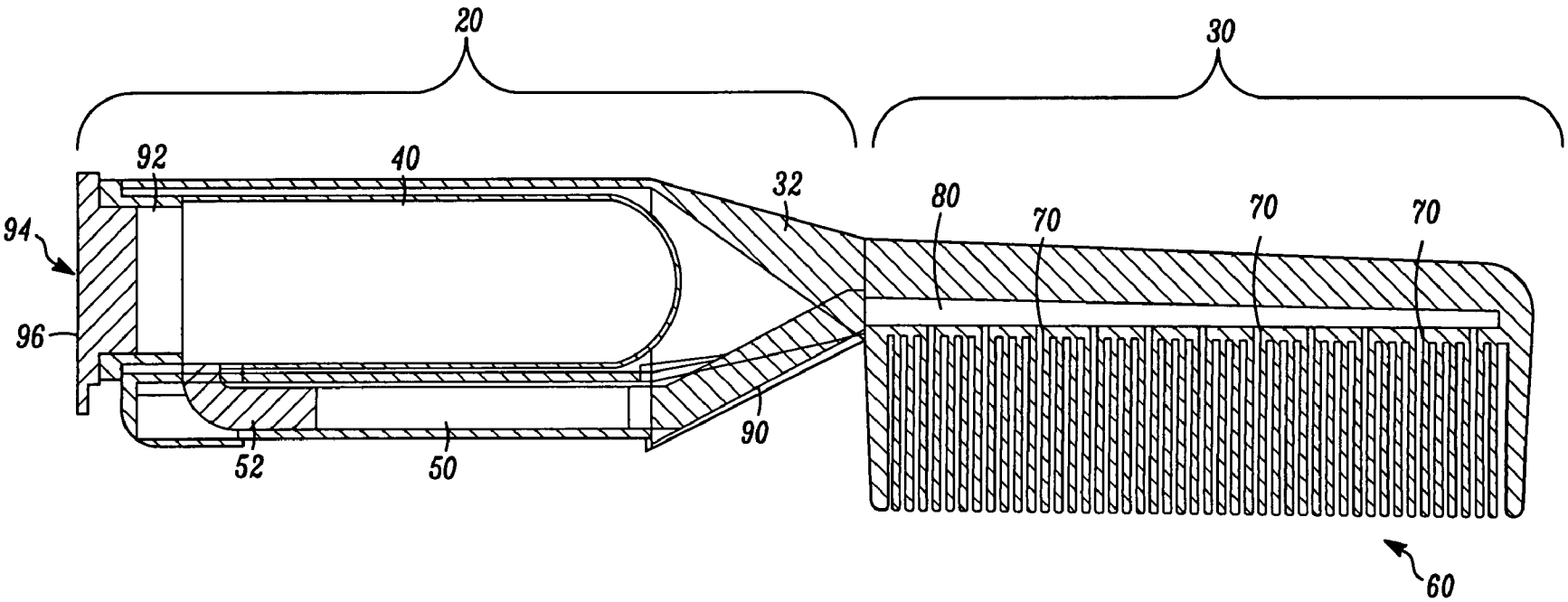
FIG. 1 is a cross-sectional view of a liquid dispensing comb in accordance with an exemplary embodiment.

FIG. 1 is a cross-section view of a liquid dispensing comb 10 that includes a handle portion 20 and a head portion 30 shown in accordance with an exemplary embodiment. The handle portion 20 includes a handle body 32, a container 40 and a compressible chamber 50. The container 40 may for example, include a collapsible bladder, bag, cylinder and/or piston, spring or other suitable structure to store and dispense the liquid. The handle portion 20 comprises an opening 92 along with a cap 96 on the bottom end 94 opposite the head portion 30.

According to one embodiment, the compressible chamber 50 is operative to receive the liquid from the container 40 via an inlet valve 52. The inlet valve 52 may include a suitable ball bearing and spring, such as a ball check valve, as is commonly known in the art. The inlet valve 52 opens when a vacuum is created in the compressible chamber 50. Such a vacuum may be created when the pressure in the container 40 is greater than the pressure in the compressible chamber 50. As a result, the inlet valve 52 allows the liquid to flow from the container 40 to the compressible chamber 50. The inlet valve 52 also functions to prevent liquid from traveling back into the container 40 when the compressible chamber 50 is compressed or squeezed.

The head portion 30 includes a plurality of teeth 60, a plurality of nozzles 70 located between the teeth 60 and a common delivery channel 80. The common delivery channel 80 may be operably coupled to the compressible chamber 50 and the plurality of nozzles 70. The plurality of teeth 60 may be aligned substantially in a row so that the plurality of teeth 60 are located within a row, or may be linearly offset with respect to each other.

According to one embodiment, an outlet valve 90 couples the compressible chamber 50 to the common delivery channel 80 to deliver pressurized liquid to the common delivery channel 80 in response to, for example, squeezing the compressible chamber 50. According to one embodiment, the inlet valve 52 and the outlet valve 90 are both one-way valves such as a ball bearing and spring, diaphragm(s), cylinder and/or piston or any suitable type of valve(s). As a result, when the liquid in the compressible chamber 50 is pressurized, by for example squeezing the compressible chamber 50, then the pressurized liquid is directed to the common delivery channel 80. Upon expulsion of liquid from the compressible chamber 50 and upon the user releasing the compressible chamber 50, the inlet valve 52 opens while the outlet valve 90 closes and the compressible chamber 50 expands creating a vacuum to draw liquid from the container 40 in preparation for another cycle of operation. Thus, the operation of the compressible chamber 50 functions, for example, in a two-stage operation, namely an input cycle and an output cycle corresponding with the release and squeeze of the compressible chamber 50. The operation may occur in one, two, or three stages or any suitable number of stages.

According to one embodiment, the compressible chamber 50 may be made of flexible material, such as rubber, metal or plastic or any other suitable material. Although the liquid in the compressible chamber 50 is described as pressurized in response to a user's hand squeezing the compressible chamber 50, the compressible chamber 50 may compress the liquid via any suitable device. According to one embodiment, the compressible chamber 50 may be activated via a trigger and pressure application device (i.e. cylinder and/or piston), twisting actuator, or any suitable actuation device. According to an alternative embodiment, the compressible chamber 50 may include a motor, such as an electric motor, manual or motorized pump or any suitable device. Although the compressible chamber 50 is shown generally oriented on the handle portion 20 in the same direction as the plurality of teeth 60, the compressible chamber 50 may be oriented in any position on the handle portion 20, including in a position suitable for actuation by a user's finger or thumb.

Figure 2:
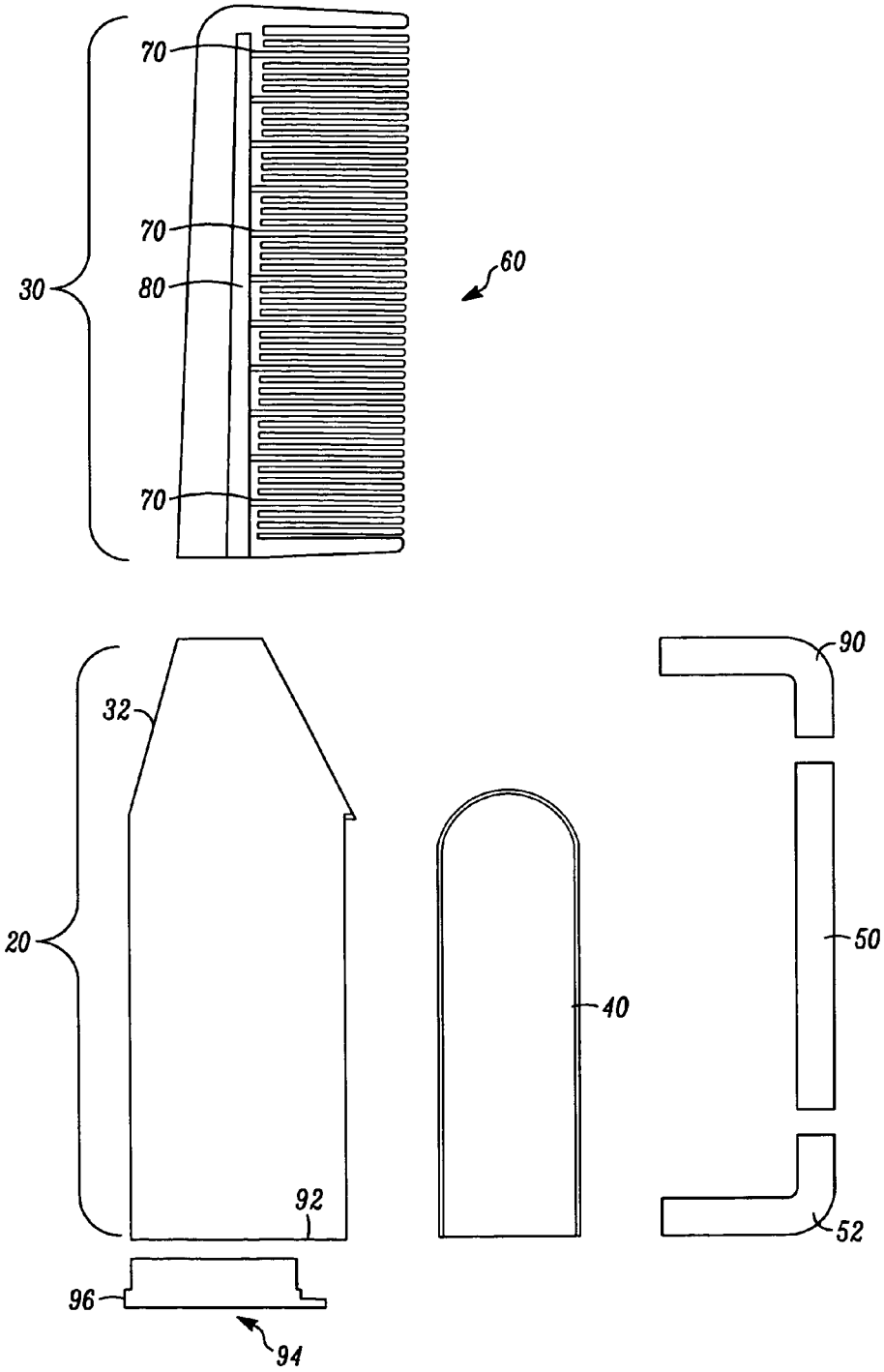
FIG. 2 is an exploded view of the liquid dispensing comb according to one embodiment.

FIG. 2 is an exploded view of the liquid dispensing comb 10 according to one embodiment. The common delivery channel 80 may be tapered to gradually narrow as shown in FIGS. 1 and 2 in order to facilitate manufacture. For example, the taper may facilitate the insertion of an injection type of probe into a suitable mold (not shown). An alternative manufacturing method may be employed in order to facilitate a non-tapered common delivery channel 80. Alternatively, the common delivery channel 80 may include a taper increasing towards the top of the head portion 30.

According to one embodiment, the plurality of nozzles 70 dispenses the liquid in a relatively uniform manner. For example, the plurality of nozzles 70 may be sized such that the liquid is relatively uniformly dispensed via the plurality of nozzles. In response to squeezing the compressible chamber 50, the liquid in the compressible chamber 50 is compressed resulting in pressurized liquid in the common delivery channel 80. The resulting pressure in the common delivery channel 80 may be greater than the pressure of the liquid sprayed out of the plurality of nozzles 70 resulting in an approximately uniform pressure within the common delivery channel 80 to produce relatively uniform spraying of the liquid amongst the plurality of nozzles 70. Alternatively, a gradually widening taper for the common delivery channel 80 increasing toward the top of the head portion 30 may be employed in order to facilitate providing substantially relative uniform liquid delivery amongst the plurality of nozzles 70. According to this embodiment, the gradually widening taper may provide a greater rate of liquid delivery using larger holes for the plurality of nozzles 70.

According to one embodiment, the container 40 does not substantially displace the liquid with air when the compressible chamber 50 draws liquid from the container 40. As a result, the container 40 is substantially without gas [i.e. air], except possibly for a relatively small amount of air initially in the container 40, as the compressible chamber 50 dispenses liquid from the container 40. For example, this may occur if the user does not fill the container 40 completely with water.

The container 40 may be formed from or consists of a collapsible substrate, such as a non-porous bladder, to function as a reservoir to collapse as the liquid level decreases. The bladder may include folds similar to an accordion in order to allow the bladder to collapse and expand in response to the liquid displaced within the bladder. The bladder may be made of plastic, rubber, metallic foil or any suitable material and may further be covered with wax to facilitate collapsing and expanding the bladder. According to one embodiment the bladder may be made of rubber that is 0.01 inches in thickness although the thickness of the rubber may be different in order to provide different properties desired, such as resilience and compressibility. Additionally, even if the user only partially fills the container 40 with liquid, resulting in some air in the container 40, then pumping of the compressible chamber 50 may expel the air in the container 40 via inlet valve 52. For example, since the inlet valve 52 would substantially draw the liquid and/or air from the container 40 only in this direction, then any air in the container 40 would eventually be expelled by suitable pumping of the compressible chamber 50, resulting eventually in dispensing a substantial amount of the liquid in the container 40.

Figure 3:
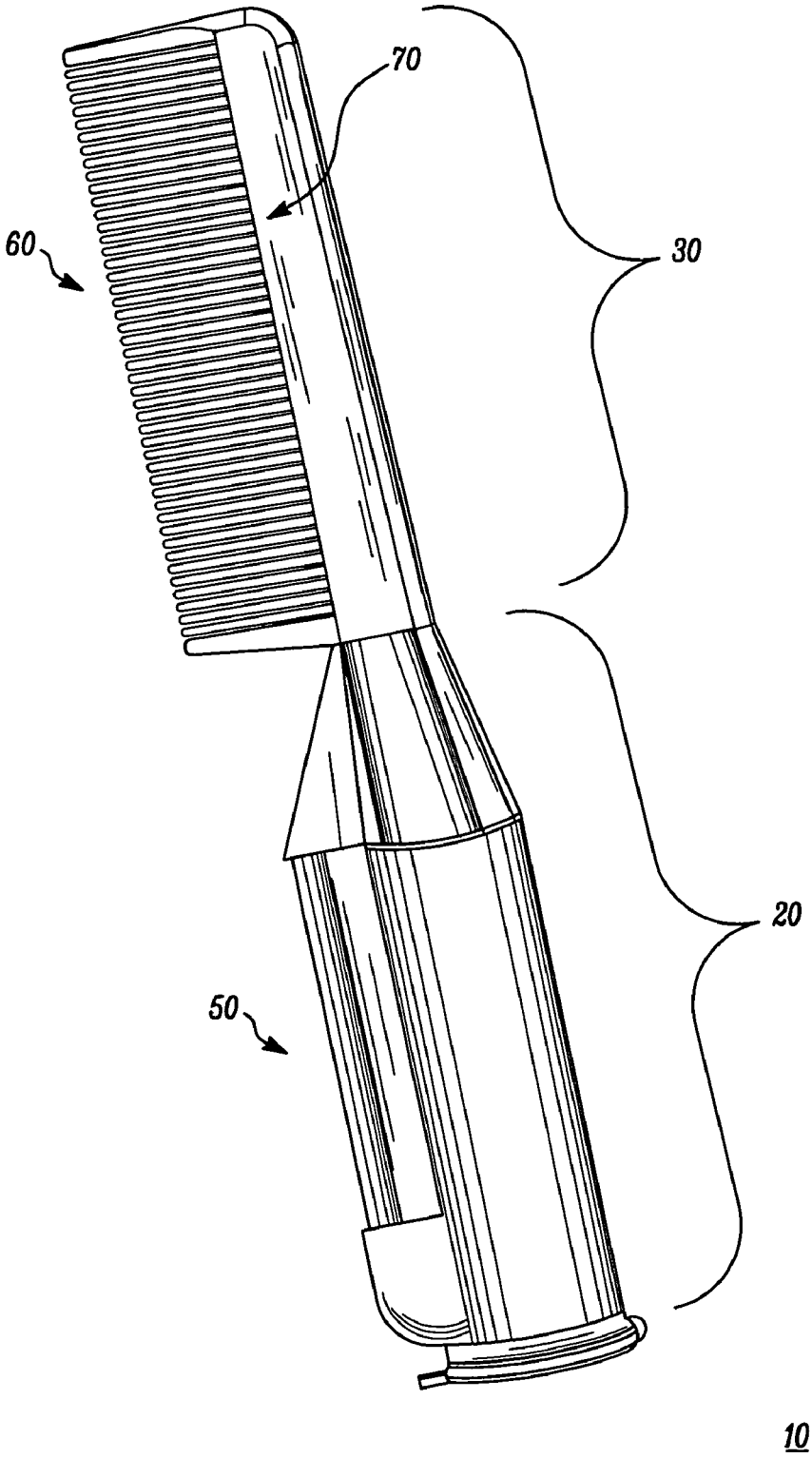
FIG. 3 is a view of the liquid dispensing comb from the perspective of a user according to one embodiment.

FIG. 3 is a view of the liquid dispensing comb from the perspective of a user according to the alternative embodiment. According to one embodiment, the handle portion 20 and the head portion 30 are formed from at least one comb body piece. The liquid dispensing comb 10 may appear as a single structure to the user such that the liquid dispensing comb 10 requires no assembly by an end user. According to one embodiment, the container 40, compressible chamber 50, inlet valve 52, outlet valve 90, and other suitable components may be fully assembled during manufacture. As a result, further assembly or disassembly of these components is not required by the end user.

Figure 4:
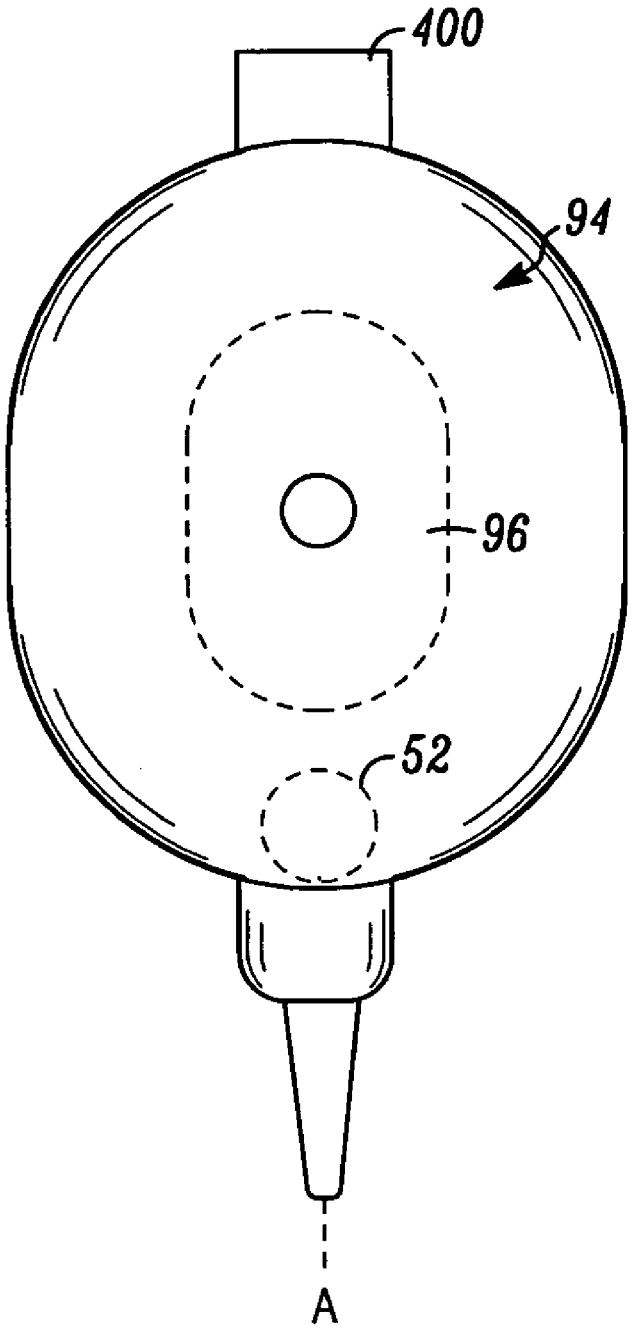
FIG. 4 is an end view of the liquid dispensing comb from the perspective of the handle portion end according to one embodiment.

FIG. 4 is an end view of the liquid dispensing comb 10, from the perspective of the handle portion 20 bottom end 94. According to one embodiment, the handle portion 20 comprises the opening 92 (shown in FIGS. 1 and 2) on the bottom end 94 being an opposing end of the head portion 30. The cap 96 may be operably unengaged from the opening 92 via hinge 400 to allow refilling with water and cleaning of the container 40. Although the opening 92 and cap 96 is shown on the bottom end 94 of the liquid dispensing comb 10, the opening 92 and cap 96 may alternatively be located on any portion of the liquid dispensing comb 10. The cap 96 may operably seal the end of the container 40 via a compression fit or via threads on cap 96 with corresponding threads on the opening 92, a plug or any suitable sealing and/or fastening mechanism.

Figure 5:
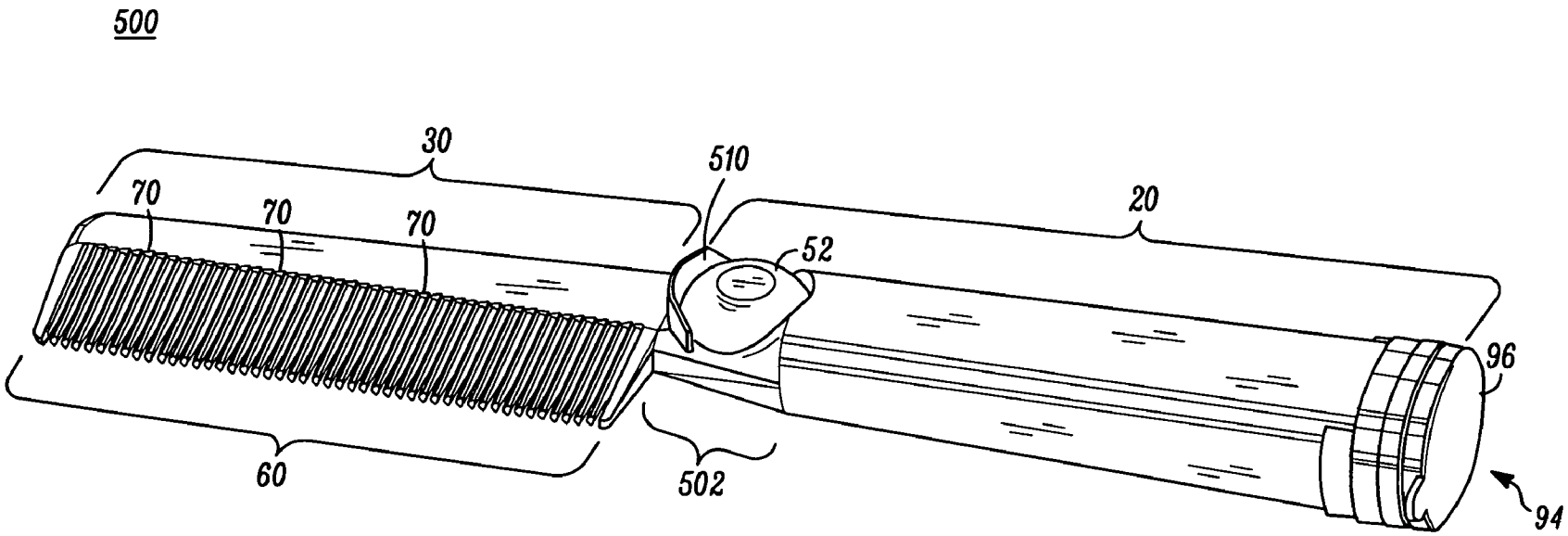
FIG. 5 is a perspective view of a liquid dispensing comb in accordance with another exemplary embodiment.

FIG. 5 is a perspective view of a liquid dispensing comb 500 in accordance with another exemplary embodiment. According to this embodiment, the compressible chamber 502 is located on a long side of the handle portion 20, i.e. a same plane as the head 30 and the plurality of nozzles 70. A user may therefore efficiently actuate the compressible chamber 502 by the user's thumb while comfortably holding the handle portion 20. According to one embodiment, a guard 510 guides a user's thumb to comfortably depress the compressible chamber 502. The guard 510 also ensures that the compressible chamber 502 is not unintentionally depressed in the event the liquid dispensing comb 500 is inadvertently dropped or bumped by another object.

Figure 6:
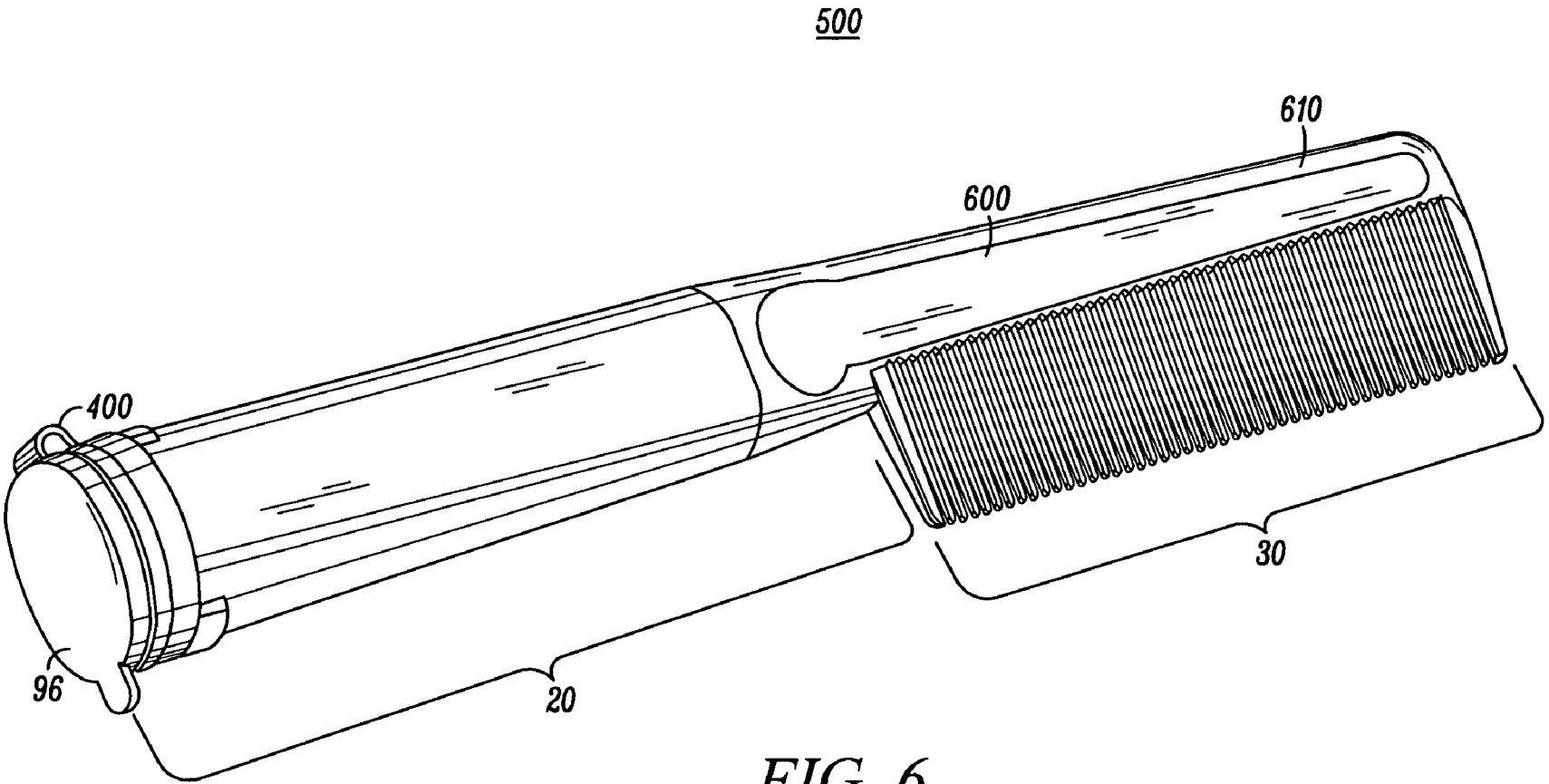
FIG. 6 is a perspective view of the liquid dispensing comb showing the common delivery channel in accordance with another exemplary embodiment.

FIG. 6 is a perspective view of the liquid dispensing comb 500. The head portion 30 includes a common delivery channel molded portion 600 in accordance with another exemplary embodiment. According to this embodiment, the common delivery channel molded portion 600 is molded into an inner portion of a comb body 610 of the head portion 30. The common delivery channel molded portion 600 also includes an end portion suitable for forming a back side of the outlet valve 90.

Figure 7:
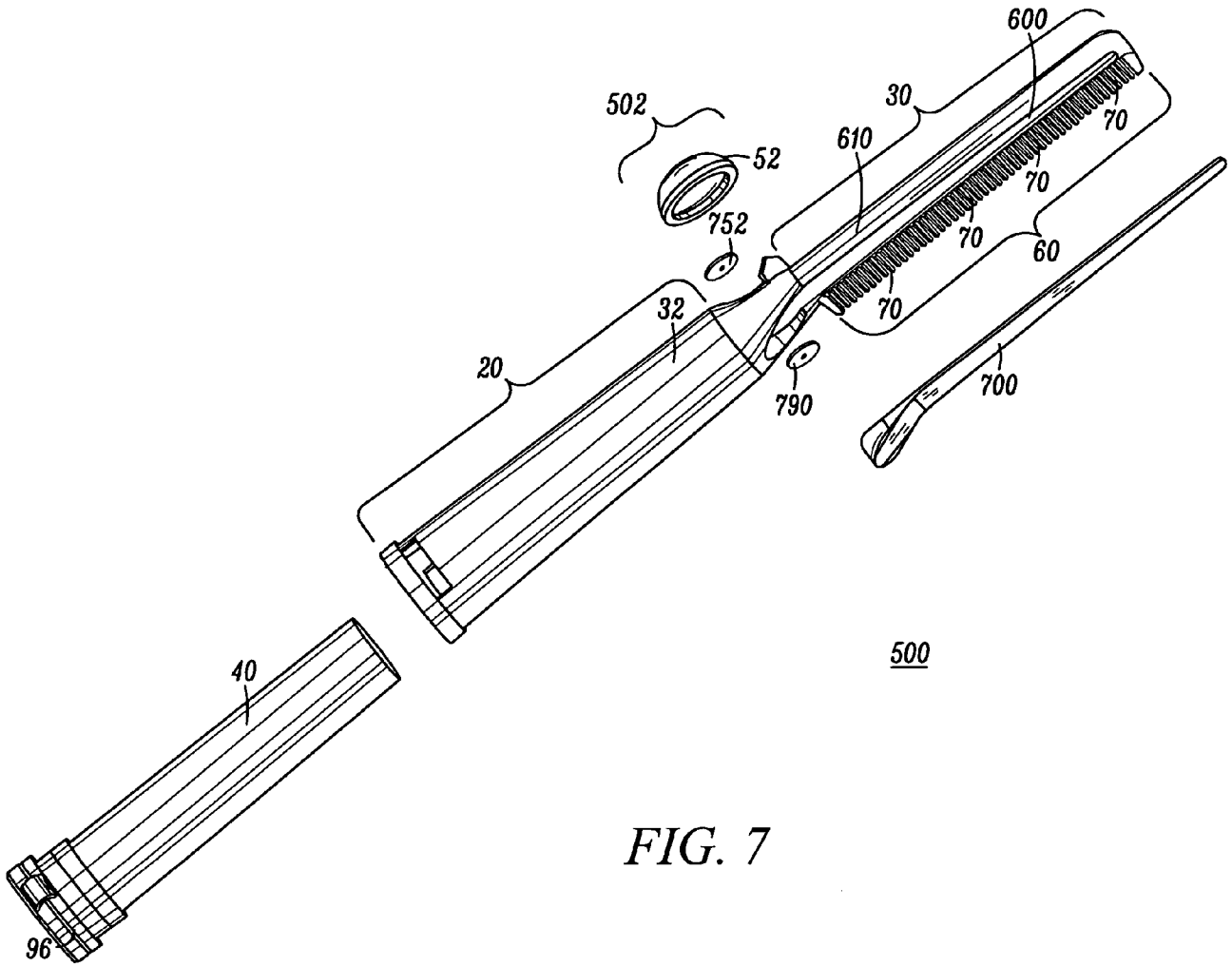
FIG. 7 is an exploded view of the liquid dispensing comb according to the embodiment shown in FIG. 5.

FIG. 7 is an exploded view of the liquid dispensing comb 500 according to the embodiment shown in FIG. 5. According to this embodiment, a common delivery channel cover 700 covers the common delivery channel molded portion 600 formed on an inner portion of the head portion 30 on the comb body 610. For example, the common delivery channel cover 700 and the common delivery channel molded portion 600 together form a common delivery channel 600, 700. The common delivery channel cover 700 may be affixed to the head portion 30 by glue, heat welding, ultrasonic welding, prongs, screws or any suitable mechanism or method of attachment. A gasket may be used to provide a hermetic or otherwise water tight and/or air tight seal.

The compressible chamber 502 further includes an inlet valve disc 752 and an outlet valve disc 790. The compressible chamber 502 is operative to receive the liquid from the container 40, such as the bladder as previously described, via the inlet valve disc 752. The compressible chamber 502 ejects the liquid via the outlet valve disc 790.

Figure 8:
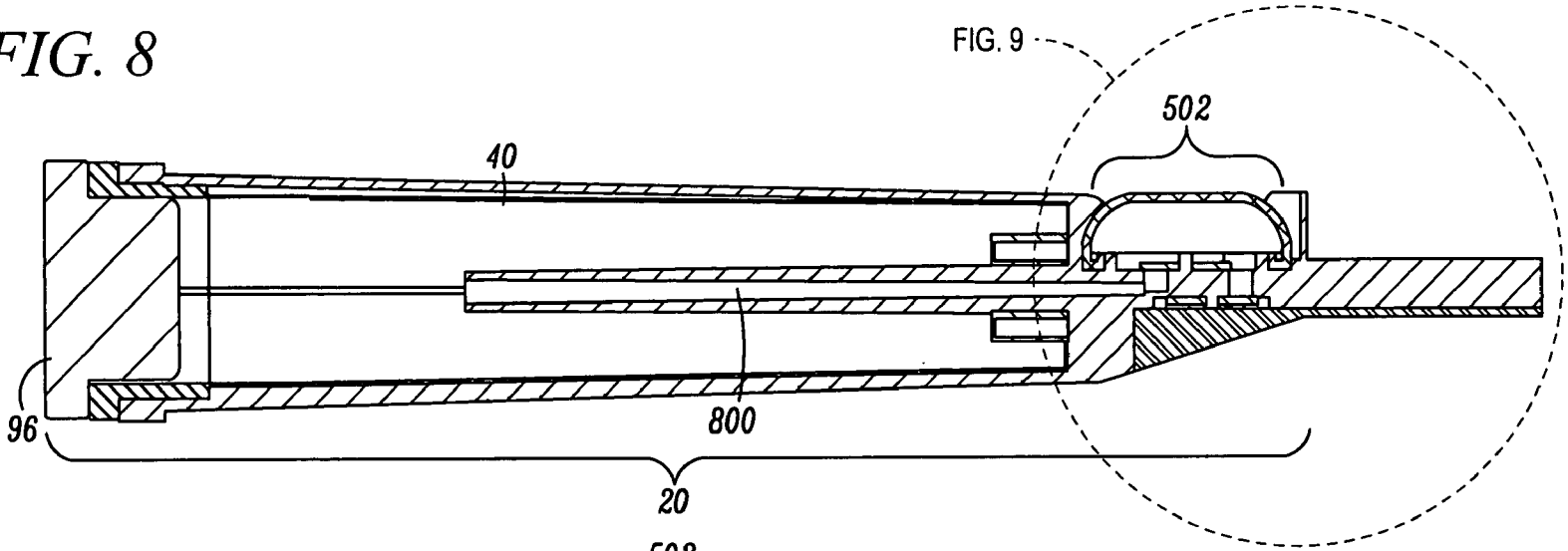
FIGS. 8 and 9 are cross-sectional views of a handle portion according to the embodiment shown in FIG. 5.
Figure 9:
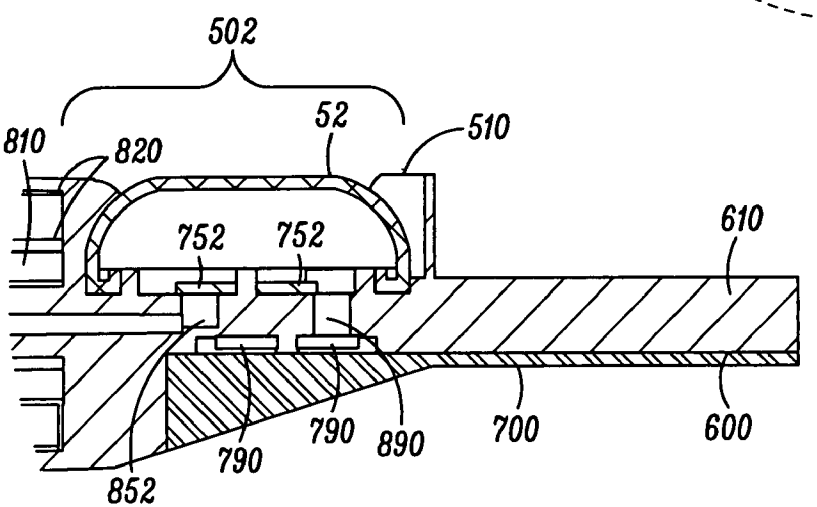

FIGS. 8 and 9 are cross-sectional views of the handle portion 20 according to the embodiment shown in FIG. 5. According to one embodiment, the compressible chamber 502 is operative to receive the liquid from the container 40, such as the bladder, via a tube 800 coupled to the inlet valve disc 752. The tube 800 is sealed with the container 40 via a boss 810 to form a step 820 at the end of the container 40. For example, during assembly, the tube 800 is inserted into boss 810 of container 40 and may form an undetachable piece.

The compressible chamber 502 further includes an inlet valve channel 852 and an outlet valve channel 890 formed in the comb body 610. The inlet valve disc 752 opens when a vacuum is created in the compressible chamber 502. Such a vacuum may be created when the pressure in the container 40 is greater than the pressure in the compressible chamber 502. As a result, the inlet valve disc 752 allows the liquid to flow from the container 40 to the compressible chamber 502 via the tube 800 and the inlet valve channel 852. The inlet valve disc 752 also functions to prevent liquid from traveling back into the container 40 when the compressible chamber 502 is compressed or squeezed.

According to one embodiment, the outlet valve channel 890 couples the outlet valve disc 790 to deliver pressurized liquid to the common delivery channel 600, 700 in response to, for example, depressing the compressible chamber 502. When the liquid in the compressible chamber 502 is pressurized, by for example pressing the cover 52, then the pressurized liquid is directed to the common delivery channel 600, 700. Upon expulsion of liquid from the compressible chamber 502 and upon the user releasing the cover 52, the inlet valve disc 752 opens while the outlet valve disc 790 closes and the compressible chamber 502 expands to draw liquid from the container 40 in preparation for another cycle of operation.

According to one embodiment, the inlet valve disc 752 and the outlet valve disc 790 are both one-way valves such as a diaphragm and optional spring, or any suitable type of valve. For example, any other suitable type of valve may be used such as a ball bearing and spring valve. The inlet valve 52, 752 and the outlet valve 90, 790, as referenced in FIGS. 1 and 7, may include a suitable curved disc or a relatively substantially flat disc and optional spring, such as a check valve, as is commonly known in the art. For example, the disc may be cupped, but pressed flat during manufacture to provide built-in resiliency. Further, the inlet valve 52, inlet valve disc 752, outlet valve 90, outlet valve disc 790, and comb body 610 may be manufactured from rubber, plastic, metallic foil or any suitable material.

Figure 10:
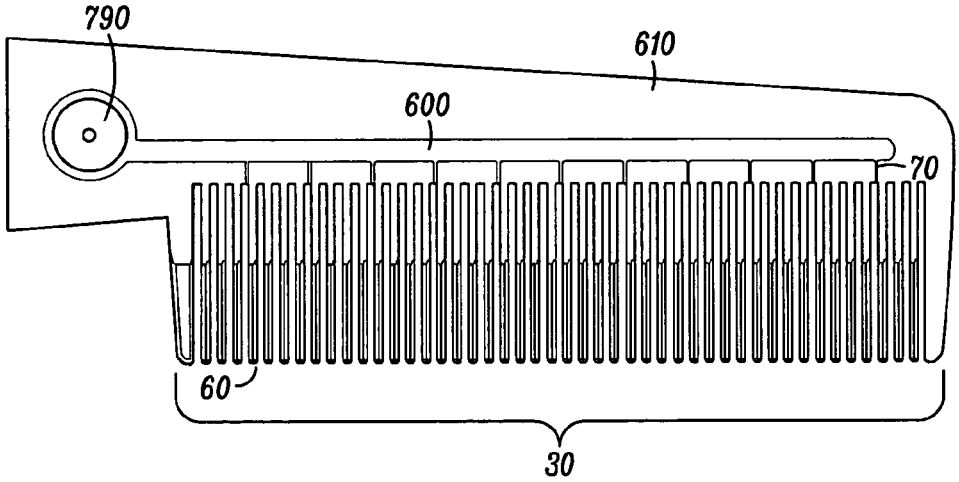
FIG. 10 is a cross-sectional view of a head portion according to the embodiment shown in FIG. 5.

FIG. 10 is a cross-sectional view of the head portion 30 according to the embodiment shown in FIG. 5. According to this embodiment, the plurality of nozzles 70 is located between the teeth 60 and the common delivery channel molded portion 600. Further, the nozzles 70 may be sized with an appropriate diameter to provide a suitable capillary action in order to hold liquid in the plurality of nozzles 70 when not spraying. As a result of capillary action, movement of the head portion will typically not result in the unintended release of liquid. Even shaking of the comb 10, 500 may result in only a small amount of water to be released. Pumping of the compressible chamber 502 will quickly refill the common delivery channel 600, 700 to replace the relatively small amount of water displaced from the plurality of nozzles 70.

Figure 11:
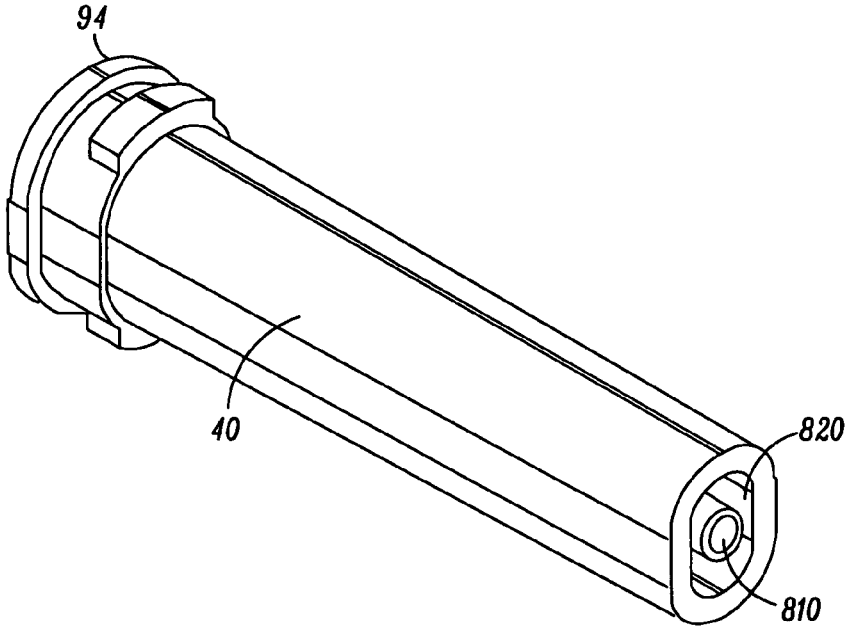
FIG. 11 is a perspective view of a container in accordance with another exemplary embodiment.

FIG. 11 is a perspective view of the container 40 in accordance with the embodiment shown in FIG. 5. According to one embodiment, the perimeter of the container 40 whose walls collapse or move, such as the bladder, detaches and slides backward as the liquid is pumped out in order to allow the container 40 to collapse. The end of the container 40 is secured with the boss 810 to provide a leak proof seal around the tube 800. The container 40 may have an accordion shape in order to facilitate compression and expansion as previously discussed.

Among other advantages, the liquid dispensing comb 10, 500 allows the user to spray out substantially all of the available liquid while holding the comb in any orientation. The container 40 suitably collapses as the compressible chamber 502, 600, 700 draws liquid from the container 40 so that either no air, a minimal amount of air or a substantially small amount of air is introduced into the container 40 as the compressible chamber 502, 600, 700 draws liquid from the container 40. As a result, the compressible chamber 502, 600, 700 may draw liquid from the container 40 when the liquid dispensing comb 10, 500 is in any position or orientation, such as when the liquid dispensing comb 10, 500 is moved or rotated. Additionally, the plurality of nozzles 70 located between the teeth 60 uniformly dispense the liquid. Among other applications, the liquid dispensing comb 10, 500 facilitates dispensing of the liquid while combing to assist in detangling, styling, combing and any other suitable activity. For example, the liquid dispensing comb 10, 500 quickly and efficiently facilitates combing the hair of a child. Further, the liquid dispensing comb 10, 500 preferably appears as a single structure to the user such that the liquid dispensing comb 10, 500 requires no assembly by a user. The liquid dispensing comb 10, 500 may therefore be easily and inexpensively manufactured using common manufacturing techniques.

It is understood that the implementation of other variations and modifications of the present invention in its various aspects will be apparent to those of ordinary skill in the art and that the invention is not limited by the specific embodiments described. It is therefore contemplated to cover by the present invention any and all modifications, variations or equivalents that fall within the spirit and scope of the basic underlying principles disclosed and claimed herein.

What is claimed is:

1. A liquid dispensing comb comprising:

a handle portion;

a head portion coupled to said handle portion;

a collapsible container operative to store a liquid disposed within said handle portion, said handle portion having an opening opposite the said head portion;

a cap removably closes said opening so as to provide access to said collapsible container, said collapsible container having an outlet;

a one way inlet valve coupled to said outlet;

a compressible chamber having two ends, wherein one end of said compressible chamber coupled to said one way inlet valve;

a one way outlet valve coupled to the other end of said compressible chamber;

a common delivery channel coupled to said one way outlet valve, wherein said compressible chamber disposed on the handle portion adjacent to the collapsible container and communicating with said common delivery channel, said head portion comprising a plurality of teeth; and a plurality of nozzles located between said plurality of teeth, wherein when pressurizing said compressible chamber, said liquid flows from the collapsible container into said plurality of nozzles via said common delivery channel.

2. The liquid dispensing comb of claim 1 wherein the comb forms a one piece body.

3. The liquid dispensing comb of claim 1 wherein the plurality of nozzles uniformly dispenses the liquid.

4. The liquid dispensing comb of claim 3 wherein the plurality of nozzles are sized such that the plurality of nozzles uniformly dispenses the liquid.

5. The liquid dispensing comb of claim 1 wherein the collapsible container is substantially without gas as liquid is dispensed from the container.

6. The liquid dispensing comb of claim 1 wherein the liquid dispensing comb dispenses the liquid in substantially any orientation.

7. The liquid dispensing comb of claim 1 wherein the compressible chamber dispenses substantially all of the liquid in the collapsible container.

8. The liquid dispensing comb of claim 1 wherein the collapsible container is at least one of: an accordion, a substrate, a bag and/or a bladder.

9. The liquid dispensing comb of claim 1 wherein the liquid dispensing comb requires no assembly by a user.

10. The liquid dispensing comb of claim 1 further including a trigger to actuate the compressible chamber.

* * * * *